United States Patent [19]

Grinblat

[11] Patent Number: 4,902,322

[45] Date of Patent: Feb. 20, 1990

[54] SUPPLEMENTAL AIR CONDITIONING SYSTEM FOR BUILDING

[76] Inventor: Ronald Grinblat, 230 Parsells La., Closter, N.J. 07624

[21] Appl. No.: 287,837

[22] Filed: Dec. 21, 1988

[51] Int. Cl.[4] ..... F25D 23/12

[52] U.S. Cl. ..... 62/259.1; 165/22

[58] Field of Search ..... 62/259.1, 324.1; 98/31.6; 165/22, 48.1

[56] References Cited

U.S. PATENT DOCUMENTS

| | | | |
|---|---|---|---|
| 2,200,215 | 5/1940 | Lewis | 62/259.1 X |
| 2,500,695 | 3/1950 | McGrath | 62/259.1 X |
| 3,720,258 | 3/1973 | Chandler | 165/22 X |
| 3,789,621 | 2/1974 | Inuzuka | 62/259.1 X |
| 4,024,728 | 5/1977 | Gustafsson | 62/324.1 X |
| 4,084,388 | 4/1978 | Nelson | 165/22 X |
| 4,413,478 | 11/1983 | McFarlan | 165/22 X |

*Primary Examiner*—Lloyd L. King

*Attorney, Agent, or Firm*—Eliot S. Gerber

[57] ABSTRACT

A building has a core through which the building supplies primary cooled air for air conditioning and cooled water (condenser water). A tenant who requires a lower temperature in his floor space may install a supplemental air conditioning system. The system of the present invention is a supplemental air conditioning system which uses less condenser water and employs a mix of air-cooled and water-cooled air conditioning units in the range of ratios from 85:15 to 70:30, in terms of cooling capacity.

4 Claims, 2 Drawing Sheets

SUPPLEMENTAL AIR CONDITIONING SYSTEM FOR BUILDING

BACKGROUND OF THE INVENTION

1. Field of the Invention

The present invention relates to air conditioning systems and more particularly to supplementary air conditioning systems for buildings whose primary air conditioning system is a forced air system.

2. Description of the Prior Art

At the present time multi-tenant office buildings, malls and other buildings are often constructed with central air conditioning which cools by circulation of air (forced air system). Generally the air conditioning equipment is located at a room or floor for machinery. For example, in a multi-story building, one mechanical floor may serve sixteen floors, eight above and eight below, so that a 48-floor building would have three mechanical floors. The ducts for the flow of air from the floors to, and from, the mechanical floor are arranged in the core of the building. The building core also contains other service ducts, the main water pipes and the elevators.

The temperature of the air supplied by the building to the tenants' space for cooling, and the air returned from the tenants' space to the mechanical room, is controlled by a control system. Those temperatures are set to accord with Federal, State and local law and the building owner's lease commitments to his tenants. Presently, generally the cooling air is supplied at each tenant's space at 55° F. and the return air from the floor to the ceiling plenum (space above the ceiling) is set at 78° F. Since the ceiling plenum contains lights and other heat-producing equipment, the air returns to the building core at about 80° F. The building uses cooling towers for heat rejection and chillers and fan-coil units to cool the air. The temperature on the tenants' spaces is consequently 78° in the summer, and may be even warmer in those portions of the floors exposed to direct sunlight.

However, a temperature of 78° F. is too warm for some equipment and material, for example library books, and sensitive electronic equipment, such as computer terminal equipment used in broker offices. A temperature of 78° F., with its accompanying high humidity, is sufficient to cause mildew on library books and documents.

Some tenants require a lower air conditioning temperature, and lower humidity, than is supplied by the building. Such tenants have installed water-cooled supplemental air conditioning units which are supplied with cooling water, called "condenser water" as the water cools the condensers of the units, by the building from the main or a separate cooling tower called a "tenant cooling tower". For example, a typical rented floor of 28,000 sq. feet (rentable) would use 25 tons of supplemental air conditioning units to reduce the temperature on that floor form 78° F. to 72° F. The supplemental air conditioning may be supplied by five free-standing or ceiling units each of 5 tons capacity which are cooled by condenser water supplied through pipes from the building's main cooling water pipes. The buildings charge for that water, a typical charge in New York City being a flat charge of from one or two thousand dollars per ton (12,000 BTU/Hr.) of installed supplemental air conditioner capacity, each year, regardless of actual usage. A tenant having a 25-ton supplemental air conditioning system will pay, at that rate, of two thousand dollars, 50 thousand dollars a year, a 500 thousand dollars over a ten-year lease, in addition to the electrical charges for operation of the supplemental system.

Despite those high charges, some tenants have installed water-cooled supplemental air systems in order to save their books and documents, decrease the chances of computer malfunctions and improve the comfort of their employees. Generally, air-cooled units leading to outside air cannot be installed because the glass curtain or other outside walls may not be disturbed.

OBJECTIVES AND FEATURES OF THE INVENTION

It is an objective of the present invention to provide a supplemental air conditioning system for one or more spaces of a building having forced air conditioning in which the operational costs of the supplemental system are reduced because less cooling water is used.

It is a further objective of the present invention to provide such a supplemental air conditioning system which is no more costly than other competitive systems having the same cooling effect.

It is a further objective of the present invention to provide such a supplemental air conditioning system which may be less costly, and faster, to install than conventional supplemental air conditioning systems because it requires considerably fewer water lines along with their associated valves, controls and safety equipment.

It is a further objective of the present invention to provide such a supplemental air conditioning system which is safer, compared to conventional systems, from the danger of water damage due to spills from the water-cooled air conditioners and their water lines.

It is a still further objective of the present invention to reduce the demand for building water (condenser water), permitting the construction of smaller water-cooling towers and related equipment, by reducing the demand for such condenser water from tenants with supplemental air conditioning systems.

BRIEF DESCRIPTION OF THE DRAWINGS

Other objectives and features of the present invention will be apparent from the following detailed description, taken in conjunction with the accompanying drawings, in which.

SUMMARY OF THE INVENTION

In accordance with the present invention, there is provided a supplemental air conditioning system for one or more floors of a central air conditioned building using a forced air system as its primary air conditioning system. In one embodiment, a supplemental air conditioning system for a rented space consists of both air-cooled air conditioners and water-cooled air conditioners. The ratio of air-cooled air conditioners to water-cooled air conditioners is in the range, expressed in relative percentage, of total tons of capacity of from 85:15 to 70:30. The water-cooled air conditioner supplies the cooling to compensate for the work losses of the air-cooled air conditioning units. Those losses are in the range of 15% to 30% of the rated capacity of the air-cooled air conditioning units.

DETAILED DESCRIPTION OF THE INVENTION

Figure 1:
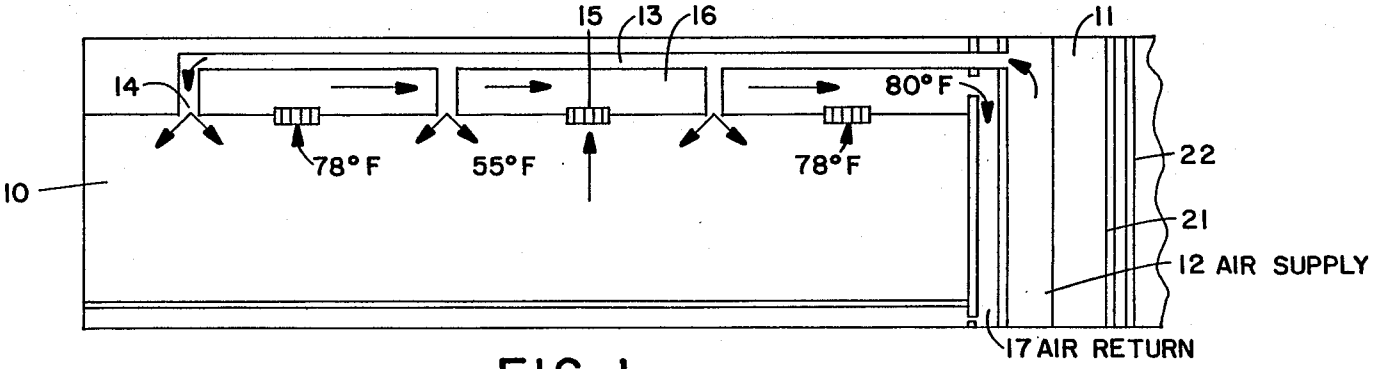
FIG. 1 PRIOR ART
FIG. 1 is a side cross-sectional view of a prior art tenants' floor without supplemental air conditioning.

A typical prior art air conditioning system is shown in FIG. 1, which represents the cross-section of a part of a tenants' floor.

The cooling air is supplied to the tenants' floor 10 from the core 11 of the building. The air, at 55°, is blown up the central air supply duct 12, through ducts 13 in the ceiling plenum 16 (the space above the false ceiling) and out into the room through diffusers 14. The air is returned, for example, at 78° F., through the ceiling grilles 15 and into the ceiling plenum 16. It is drawn from the ceiling plenum, at about 80° F., and into the air return duct 17 within the building core 11.

Figure 2:
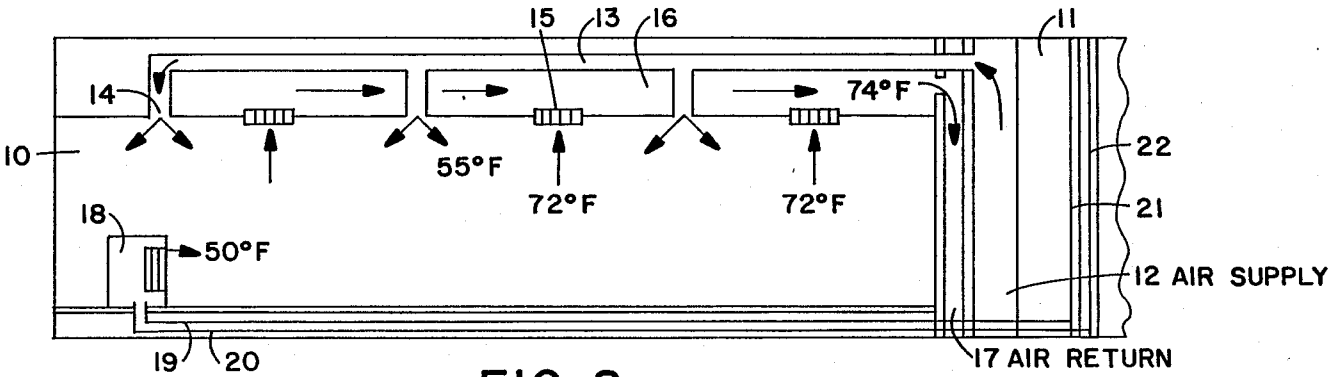
FIG. 2 PRIOR ART
FIG. 2 is a view as in FIG. 1 but with a prior art supplemental air conditioning system.

As shown in FIG. 2, the tenant, to reduce the ambient air temperature on his floor to 72°, has installed a supplemental air conditioning unit 18 of 25 ton capacity. The unit 18 is shown as a floor unit, although alternatively a multitude of floor and/or ceiling units may be used. The unit 18 is connected by water pipes 19 and 20 to the main condenser water supply pipe 21 and condenser water return pipe 22.

An analysis of the costs of the system illustrated in FIG. 1 is as follows:

| | Initial Cost (in $1000) | Annual Cost (in $1000) |
|---|---|---|
| 25 tons water-cooled AC units | 80(1) | 4.5(2) |
| Building charges @ $1500/ton for condenser water | | 37.5 |
| TOTALS | 80 | 42.0 |

(1)Initial installation cost is calculated with average $3200/ton for water-cooled units with ductwork, controls, etc., N.Y. City average with union labor (25 × 3200 = 80000).
(2)Annual energy cost is calculated using 1.5 kw/ton of cooling. 800 hours of cooling operaton and $.15/kwhr (25 × 1.5 × 800 × 1.5 = 4500).

With this system, the tenant obtains his required 72° F. ambient air temperature; but at the same time the building benefits because the air returned to its own cooling system is 6° F. lower in temperature than without the tenant's supplemental system. As a result, the building saves money because it costs less to cool colder air, but those savings are not generally returned to the tenant.

Although only one air conditioner is shown in FIG. 2, generally the 25 tons of cooling required would be divided into five separate units placed about the floor. Each uhit requires its own condenser water supply and return pipe.

Figure 3:
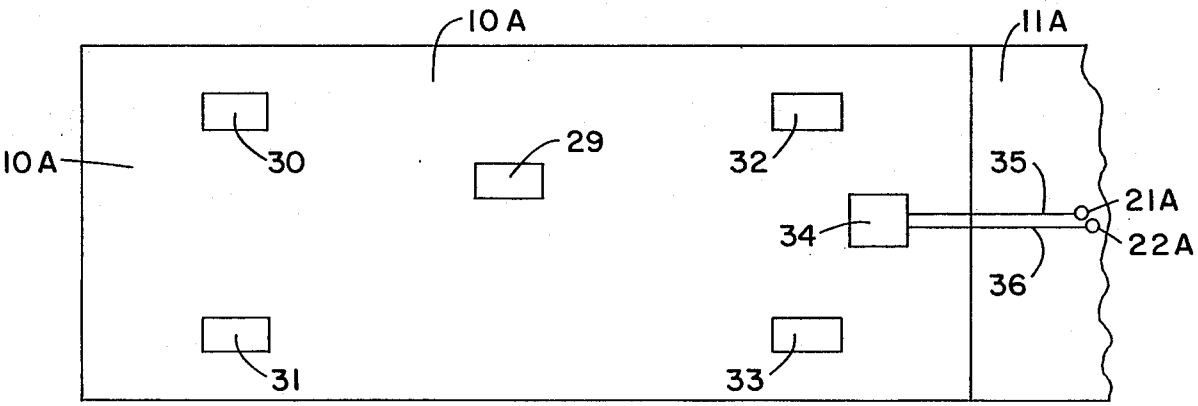
FIG. 3 is a top plan view of the supplemental air conditioning system of the present invention.
Figure 4:
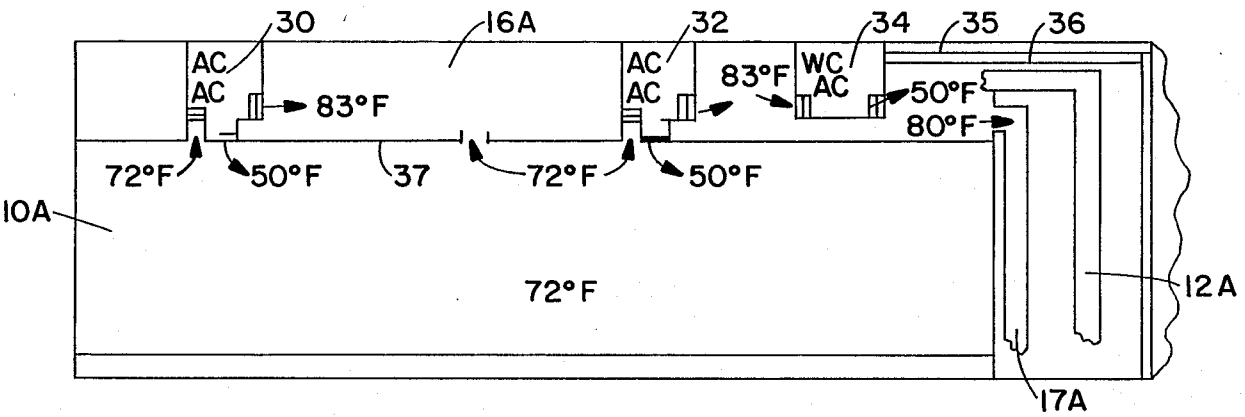
FIG. 4 is a cross-sectional view of FIG. 3.

The system of the present invention is shown in FIGS. 3 and 4. As shown, the system uses a specific combination of specially designed air-cooled and water-cooled air conditioning units. The system shown in FIGS. 3 and 4 has 32.5 tons of capacity and, in this example, uses five air-cooled air conditioning units 29–33 and one water-cooled air conditioning unit 34. Each of the units 29–33 is of 5 tons capacity and unit 34 is of 7.5 tons capacity. The only plumbing is the condenser water supply pipe 35 and return pipe 36 to the water-cooled unit 34.

The units 29–34 are shown as being hung in the ceiling plenum; but alternatively the air-cooled units may be floor units or located in the ceiling plenum. In all cases, the air used to cool the air-cooled units is blown into the ceiling plenum, generally at 83° F., and is not blown into the floor space below the false ceiling 37. The water-cooled units, which are always in the ceiling plenum, cool the mixed air in the ceiling plenum down to 80°, which is the same temperature as without supplemental cooling.

For the same size of tenant space as described above, the system of the present invention consists of 5 units each of 5 tons forming 25-ton special air-cooled units and maximum 7.5 tons (30% of 25 ton) of water-cooled units. The typical costs, in this example, are as follows:

| | Initial Cost (in $1000) | Annual Cost (in $1000) |
|---|---|---|
| 25 tons air-cooled @ $2400/ton | 60 | 4.5 (electric)(3) |
| 7.5 tons water-cooled @ $2800/ton (without ductwork) | 21 | 1.35 (electric) |
| Building charges @ $1500 ton for condenser water | | 11.25 |
| Totals | 81 | 17.10 |

(3)Generally air-cooling units are somewhat less efficient than water-cooled units, and they consume more electric energy. In this example, these special air-cooled units are about as efficient as water-cooled units because of the lower air temperature entering the condenser section.

The initial costs are substantially the same under the system of FIGS. 3 and 4, compared to the standard system shown in FIG. 2 and the first example above. However, the annual savings are substantial, about $25,000. Furthermore, the electric cost for tenant cooling water (condenser water), $1350, is more than compensated by savings in cooling tower operation, $1575 [(25−7.5)×$90/yr.=$1575)]. Therefore, the system saves energy and it saves the users substantial amounts of money.

The special air-cooled air-conditioning units may be made by changing the operating conditions of commercially available units. For example, Carrier Corp. (Division of UTC, Hartford, Conn.) sells a "50AH" horizontal indoor single-package air-cooled air conditioning unit. That 50AH unit may be modified so that it operates with air at 72°–75° F. entering the condenser and the evaporator and produces air at 50°–55° F. with a net cooling capacity of 5 tons—60,000 BTU (Model 50AH-060). There is no physical modification necessary in the unit; the only modification is in its operating conditions and controls, i.e., the temperature of 72–75 for air entering the condenser is not on the charts published for that unit and the units are not presently used at such low temperatures. Carrier also manufactures a suitable 7.5-ton water-cooled unit.

The system of FIGS. 3 and 4 uses a combination of special air-cooled and water-cooled units to provide the cooling capacity for the tenant's space. However, the system lowers the tenants requirements and annual charge for condenser (cooling) water because only 15–30% of the supplemental air conditioning uses water-cooled units. The return air to the building system is maintained at the original 80° F. as it is without any supplemental air conditioning.

In selecting the combination of units, first one determines the supplemental cooling need and utilizes special air-cooled unit(s) providing the same supplementary cooling required by the tenant, 25 tons in the examples above. The second step is to add additional water-cooled unit(s) which is required because of the additional heat generated by the electrical components (compressor and fans) of the air-cooled units. That additional heat, i.e., "work", is required for cooling. The return air temperature would rise above the original return temperature without additional cooling. The additional cooling is provided by water-cooled units which are sized to compensate for the heat produced by the electrical components of the special air-cooled units. That electrical component's heat adds up to maximum 30% of the cooling capacity of the air-cooled units, and in some cases their loss is only 15–20%.

The work loss, in the range of 15–30%, determines the ratio of air-cooled units to water-cooled units. That ratio is in the range of 85:15 to 70:30.

Modifications may be made in the above-described preferred embodiment within the scope of the claims. In the present invention the water-cooled air conditioner blows its cold air output into the ceiling plenum (space between false-drop ceiling and original ceiling) and the air-cooled units blow their cold air output to the floor space below the drop ceiling. However, the term "water cooled air conditioner", as used herein, includes units using a water and anti-freeze solution or chilled water for cooling and units using steam power or natural gas for power.

I claim:

1. A supplemental air conditioning system for a space in a building to lower the costs of using the building condenser water, used to cool the condensers of water cooled air conditioning units, said building having a core and a plurality of floor spaces and supplying said condenser water and cooled air, each floor space having a ceiling plenum formed by a drop ceiling, air conditioning ducts within the ceiling plenum to conduct said cooled air from the building core to the floor spaces, and air return means to draw heated air from the ceiling plenum and conduct said heated air to the building core, said building having a supply of said condenser water, characterized in that the supplemental air conditioning system comprises at least one air-cooled air conditioner unit and at least one water-cooled air conditioner unit having a condenser cooled by said building condenser water and located within said floor space to lower the temperature thereon in the range of 2°–10° F., each of said units blowing out cold air, with the ratio of tons of air conditioning capacity between said respective units being in the range of 85:15 to 70:30 and with the water-cooled unit blowing cold air into the ceiling plenum and the air-cooled unit blowing cold air to the floor space below said drop ceiling.

2. A supplemental air conditioner system as in claim 1 wherein the air conditioning units have a capacity in the range of 20 to 30 tons and the water-cooled air conditioning units have a capacity in the range of 3 to 9 tons.

3. A supplemental air conditioning system as in claim 1 wherein said temperature is lowered from about 78° F. to about 72° F.

4. A supplemental air conditioning system as in claim 2 wherein the system comprises a single water-cooled air conditioner unit and at least four air-cooled air conditioner units.

* * * * *